US009958823B2

(12) United States Patent
Tomita et al.

(10) Patent No.: US 9,958,823 B2
(45) Date of Patent: May 1, 2018

(54) DEVICE INCLUDING ROLLER, AND IMAGE FORMING APPARATUS AND PROCESS CARTRIDGE INCORPORATING SAME

(71) Applicants: Daisuke Tomita, Kanagawa (JP); Takeshi Shintani, Kanagawa (JP); Yasuhiro Maehata, Tokyo (JP); Yasuhito Kuboshima, Tokyo (JP); Yusuke Ishizuka, Kanagawa (JP); Nobuo Kuwabara, Kanagawa (JP); Norio Kudoh, Kanagawa (JP); Kento Aoki, Kanagawa (JP)

(72) Inventors: Daisuke Tomita, Kanagawa (JP); Takeshi Shintani, Kanagawa (JP); Yasuhiro Maehata, Tokyo (JP); Yasuhito Kuboshima, Tokyo (JP); Yusuke Ishizuka, Kanagawa (JP); Nobuo Kuwabara, Kanagawa (JP); Norio Kudoh, Kanagawa (JP); Kento Aoki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/285,919

(22) Filed: Oct. 5, 2016

(65) Prior Publication Data

US 2017/0102663 A1 Apr. 13, 2017

(30) Foreign Application Priority Data

Oct. 7, 2015 (JP) ..... 2015-199383
Aug. 4, 2016 (JP) ..... 2016-153274
Sep. 15, 2016 (JP) ..... 2016-180363

(51) Int. Cl.
*G03G 21/00* (2006.01)
*G03G 15/00* (2006.01)
*G03G 21/16* (2006.01)

(52) U.S. Cl.
CPC ..... *G03G 21/0094* (2013.01); *G03G 15/75* (2013.01); *G03G 21/1671* (2013.01)

(58) Field of Classification Search
CPC ..... G03G 21/1647; G03G 21/0094; G03G 15/75; G03G 21/1671
See application file for complete search history.

(56) References Cited

U.S. PATENT DOCUMENTS

2009/0232541 A1* 9/2009 Hatakeyama ..... G03G 15/75 399/111
2010/0189461 A1 7/2010 Shintani et al.
(Continued)

FOREIGN PATENT DOCUMENTS

JP 2014-016390 1/2014

*Primary Examiner* — Sandra Brase
(74) *Attorney, Agent, or Firm* — Oblon, McClelland, Maier & Neustadt, L.L.P.

(57) ABSTRACT

A device disposed opposing an image bearer includes a roller to rotate while contacting a surface of the image bearer, a rolling bearing fitted around a shaft located at an end of the roller in an axial direction of the roller, a frame to house the roller, and a bearing support removably attached to the frame. The rolling bearing includes an outer ring, an inner ring, and a rolling element disposed between the outer ring and the inner ring. The bearing support holds, from an outer-ring side, the rolling bearing interposed between the bearing support and the frame. The bearing support includes a receiving portion to contact the outer ring of the rolling bearing and bias the rolling bearing toward the frame in a direction in which the rolling bearing is interposed between the bearing support and the frame.

20 Claims, 10 Drawing Sheets

(56) References Cited

U.S. PATENT DOCUMENTS

| | | | | |
|---|---|---|---|---|
| 2010/0316422 | A1* | 12/2010 | Amemiya ..... | G03G 21/0094<br>399/346 |
| 2012/0134725 | A1 | 5/2012 | Kawahara et al. | |
| 2014/0010572 | A1 | 1/2014 | Karasawa et al. | |
| 2015/0301485 | A1* | 10/2015 | Yamakawa ..... | G03G 15/2053<br>399/328 |

* cited by examiner

DEVICE INCLUDING ROLLER, AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. § 119(a) to Japanese Patent Application Nos. 2015-199383 filed on Oct. 7, 2015, 2016-153274 filed on Aug. 4, 2016, and 2016-180363 filed on Sep. 15, 2016 in the Japan Patent Office, the entire disclosure of each of which is hereby incorporated by reference herein.

BACKGROUND

Technical Field

Embodiments of the present invention generally relate to a device including a roller and disposed opposing an image bearer, such as a photoconductor drum, and a process cartridge and an image forming apparatus, such as a copier, a facsimile machine, a printer, or a multifunction peripheral (MFP) having at least two of copying, printing, facsimile transmission, plotting, and scanning capabilities, that includes the device.

Description of the Related Art

There are image forming apparatuses, such as copiers and printers, which include a device (e.g., a lubricant supply device) including a roller (e.g., a lubricant supply roller) to slidingly contact an image bearer, such as a photoconductor, and the roller is held via a rolling bearing (e.g., a ball bearing) to alleviate vibration of the roller. The vibration of the roller can result in image failure such as streaks.

SUMMARY

An embodiment of the present invention concerns a device disposed opposing an image bearer to bear a toner image and includes a roller to rotate while contacting a surface of the image bearer. The device further includes a rolling bearing fitted around a shaft located at an end of the roller in an axial direction of the roller, a frame to house the roller, and a bearing support removably attached to the frame. The rolling bearing includes an outer ring, an inner ring, and a rolling element disposed between the outer ring and the inner ring. The bearing support holds, from an outer-ring side, the rolling bearing interposed between the bearing support and the frame. The bearing support includes a receiving portion to contact the outer ring of the rolling bearing and bias the rolling bearing toward the frame in a direction in which the rolling bearing is interposed between the bearing support and the frame.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
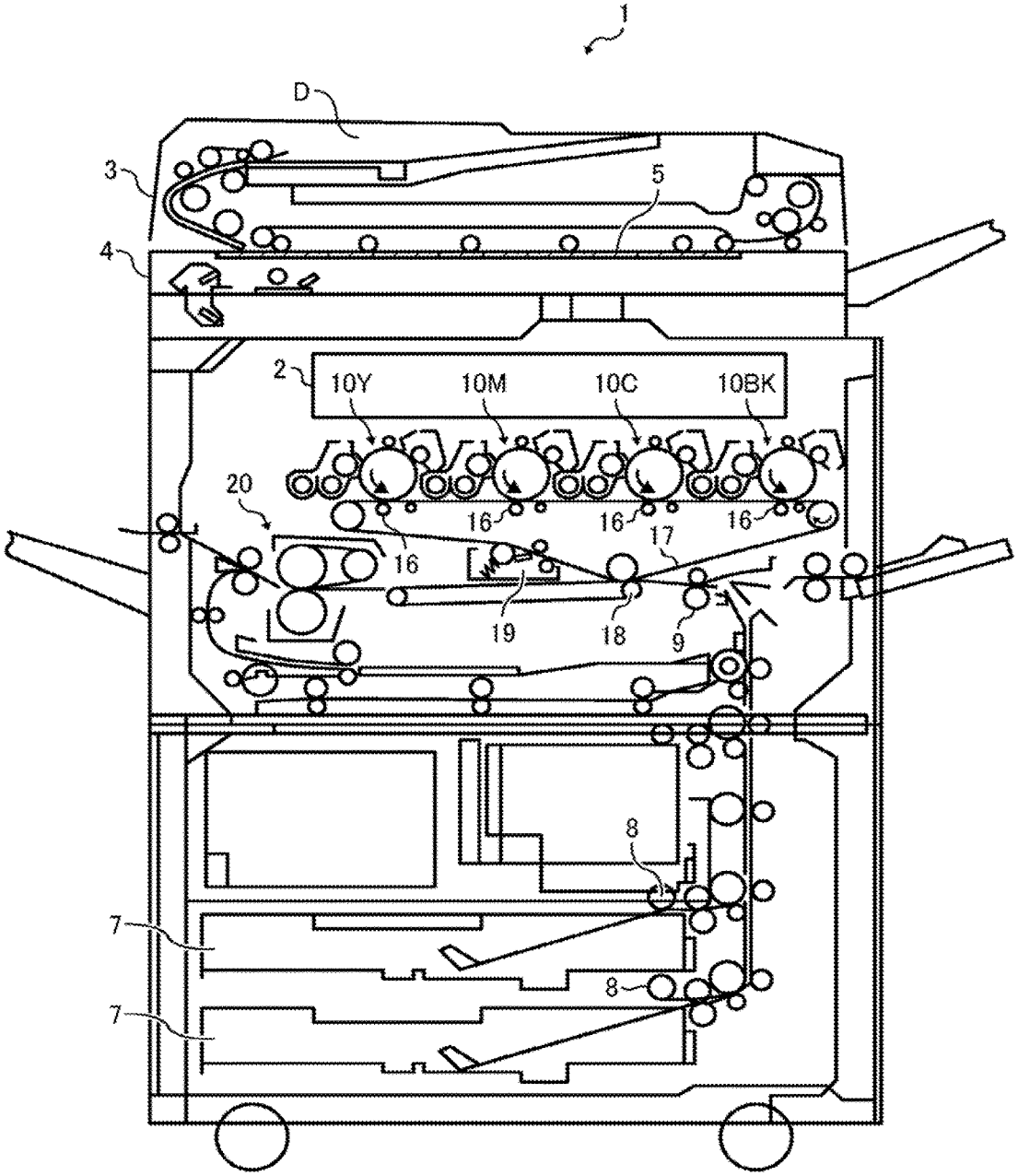
FIG. 1 is a schematic diagram illustrating a configuration of an image forming apparatus according to Embodiment 1.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 2:
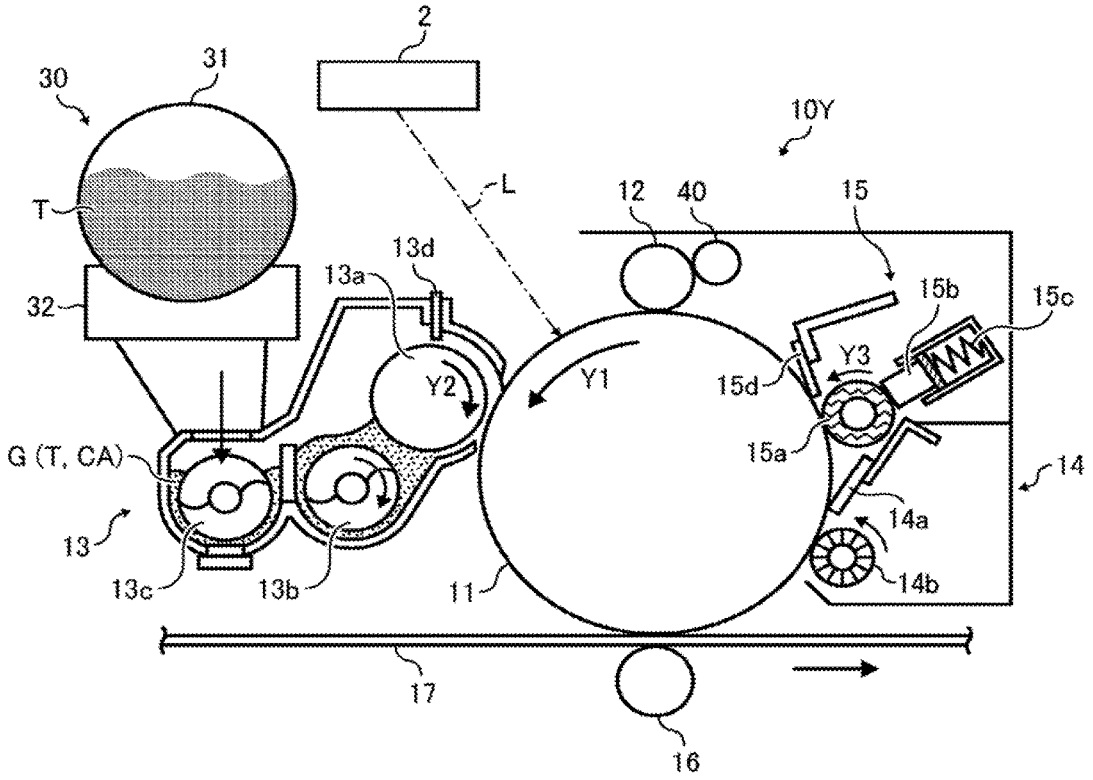
FIG. 2 is a cross-sectional view of a process cartridge in the image forming apparatus illustrated in FIG. 1.

Referring now to the drawings, wherein like reference numerals designate identical or corresponding parts throughout the several views thereof, and particularly to FIGS. 1 and 2, a multicolor image forming apparatus according to an embodiment of the present invention is described.

It is to be noted that the suffixes Y, M, C, and BK attached to each reference numeral indicate only that components indicated thereby are used for forming yellow, magenta, cyan, and black images, respectively, and hereinafter may be omitted when color discrimination is not necessary.

Embodiment 1

Embodiment 1 is described with reference to FIGS. 1 to 7.

FIG. 1 is a schematic view of an image forming apparatus 1 according to Embodiment 1. FIG. 2 is a cross-sectional view of a process cartridge 10Y (i.e., an image forming unit) for yellow, incorporated in the image forming apparatus 1 illustrated in FIG. 1.

It is to be noted that the process cartridges 10Y, 10M, 10C, and 10BK have a similar configuration except the color of toner used in image formation, and thus the process cartridge 10Y is illustrated as a representative.

In FIG. 1, the image forming apparatus 1, which in the present embodiment is a tandem-type multicolor copier, includes a writing device 2 to emit laser beams according to image data, a document feeder 3 to send a document D to a document reading unit 4 that reads image data of the document D, sheet feeding trays 7 containing recording sheets P (e.g., recording media) such as transfer paper, sheet feeding rollers 8, a registration roller pair 9 to adjust the timing to transport the recording sheet P, the process cartridges 10Y, 10M, 10C, and 10BK to form yellow, magenta, cyan, and black toner images, respectively, primary-transfer bias rollers 16 to transfer the toner images from the respective photoconductor drums 11 onto an intermediate transfer belt 17, a secondary-transfer bias roller 18 to transfer a toner image from the intermediate transfer belt 17 onto the recording sheet P, a belt cleaning device 19 to clean the intermediate transfer belt 17, and a fixing device 20 to fix the toner image on the recording sheet P.

Operations of the image forming apparatus 1 illustrated in FIG. 1 to form multicolor images are described below.

In the document feeder 3, conveyance rollers transport the documents D set on a document table onto an exposure glass 5 of the document reading unit 4. Then, the document reading unit 4 optically reads image data of the document D set on the exposure glass 5.

More specifically, the document reading unit 4 scans the image on the document D with light emitted from an illumination lamp. The light reflected by a surface of the document D is imaged on a color sensor via mirrors and lenses. The color sensor reads the multicolor image data of the document D for each of decomposed colors of red, green, and blue (RGB) and convert the image data into electrical image signals. Further, an image processor performs image processing (e.g., color conversion, color calibration, and spatial frequency adjustment) according to the image signals, and thus image data of yellow, magenta, cyan, and black are obtained.

Then, the yellow, magenta, cyan, and black image data is transmitted to the writing device 2 (i.e., an exposure device). Then, the writing device 2 directs laser beams L to the respective photoconductor drums 11 of the process cartridges 10Y, 10M, 10C, and 10BK according to the yellow, magenta, cyan, and black image data.

Meanwhile, the photoconductor drums 11 in the four process cartridges 10Y, 10M, 10C, and 10BK rotate in the direction indicated by arrow Y1 illustrated in FIG. 2 (counterclockwise in FIG. 1). The surface of the photoconductor drum 11 is charged by the charging device 12 (e.g., a charging roller) uniformly at a position facing the charging device 12 (charging process). Then, the surface of the photoconductor drum 11 is charged to a predetermined electrical potential. Subsequently, the surface of the photoconductor drum 11 thus charged reaches a position to receive the laser beam L.

The writing device 2 emits the laser beams L according to image data from four light sources. The four laser beams L pass through different optical paths for yellow, magenta, cyan, and black (exposure process).

The first one, from the left in FIG. 1, of the photoconductor drums 11 is irradiated with the laser beam L corresponding to the yellow component. A polygon mirror that rotates at high speed deflects the laser beam L for yellow in a direction of a rotation axis of the photoconductor drum 11 (main scanning direction) so that the laser beam L scans the surface of the photoconductor drum 11. Thus, an electrostatic latent image for yellow is formed on the photoconductor drum 11 charged by the charging device 12.

Similarly, the surface of the second one, from the left in FIG. 1, of the photoconductor drums 11 is irradiated with the laser beam L corresponding to the magenta component, and an electrostatic latent image for magenta is formed thereon. The surface of the third one, from the left in FIG. 1, of the photoconductor drum 11 is irradiated with the laser beam L corresponding to the cyan component, and an electrostatic latent image for cyan is formed thereon. The surface of the fourth one, from the left in FIG. 1, of the photoconductor drums 11 is irradiated with the laser beam L corresponding to the black component, and thus an electrostatic latent image for black is formed thereon.

Subsequently, the surface of the photoconductor drum 11 bearing the electrostatic latent image reaches the position facing the developing device 13. The developing device 13 supplies toner of the corresponding color to the photoconductor drum 11 to develop the latent image on the photoconductor drum 11 into a single-color toner image (developing process).

Subsequently, the surface of the photoconductor drum 11 reaches a position facing the intermediate transfer belt 17, serving as the image bearer as well as an intermediate transferor. The intermediate transferor is not limited to a belt but can be a drum. The primary-transfer bias rollers 16 are disposed in contact with an inner surface of the intermediate transfer belt 17 at the positions (i.e., transfer positions) opposite the respective photoconductor drums 11 via the intermediate transfer belt 17. At the transfer positions, the respective toner images on the photoconductor drums 11 are sequentially transferred and superimposed one on another on the intermediate transfer belt 17, into a multicolor toner image thereon (primary transfer process).

Subsequently, the surface of the photoconductor drum 11 reaches a position facing the cleaning device 14 (i.e., a cleaning section) serving as a device disposed opposing an image bearer and including a roller. At that position, a cleaning blade 14*a* and a cleaning roller 14*b* mechanically remove toner (i.e., untransferred toner) remaining on the photoconductor drum 11, and the removed toner is collected, as waste toner, in the cleaning device 14 (cleaning process).

Subsequently, the surface of the photoconductor drum 11 passes through a lubricant supply device 15 (i.e., a device disposed opposing an image bearer and including a roller) and a discharging section sequentially. Then, a sequence of image forming processes performed on each photoconductor drum 11 is completed.

Meanwhile, the surface of the intermediate transfer belt 17 carrying the superimposed toner image moves clockwise in the drawing and reaches the position opposing the secondary-transfer bias roller 18. The secondary-transfer bias roller 18 transfers the multicolor toner image from the intermediate transfer belt 17 onto the recording sheet P (secondary transfer process).

Further, the surface of the intermediate transfer belt 17 reaches a position facing the belt cleaning device 19. The belt cleaning device 19 collects untransferred toner remaining on the intermediate transfer belt 17. Thus, a sequence of transfer processes performed on the intermediate transfer belt 17 is completed.

The recording sheet P is transported from one of the sheet feeding trays 7 via the registration roller pair 9, and the like, to the secondary transfer nip between the intermediate transfer belt 17 and the secondary-transfer bias roller 18.

More specifically, the sheet feeding roller 8 sends out the recording sheet P from the sheet feeding tray 7, and the recording sheet P is then guided by a sheet guide to the registration roller pair 9 (i.e., a timing roller pair). The registration roller pair 9 forwards the recording sheet P to the secondary transfer nip, timed to coincide with the arrival of the multicolor toner image on the intermediate transfer belt 17.

Then, the recording sheet P carrying the multicolor image is transported to the fixing device 20. The fixing device 20 includes a fixing belt and a pressure roller pressing against each other. In a nip therebetween, the multicolor image (the toner image) is fixed on the recording sheet P.

After the fixing process, ejection rollers discharge the recording sheet P as an output image outside the image forming apparatus 1. Thus, a sequence of image forming processes is completed.

Referring to FIG. 2, the process cartridge 10Y is described in further detail below.

As illustrated in FIG. 2, in the process cartridge 10Y, the photoconductor drum 11 serving as an image bearer, the charging device 12 such as a charging roller, the developing device 13, the cleaning device 14, and the lubricant supply device 15 are united together.

The photoconductor drum 11 used in the present embodiment is an organic photoconductor charged in a negative polarity. The photoconductor drum 11 includes a drum-shaped conductive support body and a photosensitive layer overlying the conductive support body.

For example, the photoconductor drum 11 is multilayered and includes a base coat serving as an insulation layer, the photosensitive layer, and a protection layer (i.e., a surface layer) sequentially overlying the support body. The photosensitive layer includes a charge generation layer and a charge transport layer.

Referring to FIG. 2, the charging device 12 is a charging roller including a conductive core bar and an elastic layer of moderate resistivity overlying the core bar. The charging device 12 receives a predetermined voltage, which includes a direct-current (DC) voltage and an alternating-current (AC) voltage superimposed on the DC voltage, from a charging power source and uniformly charges the surface of the photoconductor drum 11 facing the charging device 12.

Although a compression spring presses the charging device 12 against the photoconductor drum 11 in Embodiment 1, in another embodiment, the charging device 12 is disposed across a minute gap from the photoconductor drum 11.

In Embodiment 1, a charging-roller cleaner 40 (e.g., a cleaning roller) is pressed to the charging device 12 to clean the surface of the charging device 12.

The developing device 13 includes a developing roller 13*a* disposed opposing the photoconductor drum 11, a first conveying screw 13*b* disposed opposing the developing roller 13*a*, a second conveying screw 13*c* disposed opposing the first conveying screw 13*b* via a partition, and a doctor blade 13*d* disposed opposing the developing roller 13*a*. The developing roller 13*a* includes a magnet roller or multiple magnets and a sleeve that rotates around the magnets. The magnets are stationary and generate magnetic poles around the circumference of the developing roller 13*a*. Developer G is borne on the developing roller 13*a* by the multiple magnetic poles generated on the sleeve.

The developing device 13 contains two-component developer G including carrier CA (carrier particles) and toner T (toner particles).

To improve image quality, the toner T used in Embodiment 1 is spherical toner having a circularity greater than or equal to 0.93. The ratio (D4/D1) of the weight average particle diameter (D4) to the number average particle diameter (D1) is within a range of from 1.00 to 1.40.

The circularity of the toner T is a peripheral length of a circle identical in area to a projected image of a toner particle. The circularity is obtained based on measurements by a flow-type particle image analyzer FPIA-2000 from SYSMEX CORPORATION, for example.

The weight average particle diameter and the number average particle diameter of the toner T are measured using, for example, a particle diameter measuring device, SD2000, from Hosokawa Micron Corporation.

The cleaning device 14 includes the cleaning blade 14*a* to contact the photoconductor drum 11 to clean the surface of the photoconductor drum 11 and the cleaning roller 14*b* to rotate in a predetermined direction (counterclockwise in FIG. 2) while contacting the surface of the photoconductor drum 11.

For example, the cleaning blade 14*a* is made of or includes rubber, such as urethane rubber, and contacts or abuts against the surface of the photoconductor drum 11, at a predetermined angle and with a predetermined pressure. With this configuration, substances such as untransferred toner adhering to the photoconductor drum 11 are mechanically scraped off and collected in the cleaning device 14. The substances adhering to the photoconductor drum 11 include paper dust arising from recording sheets P, discharge products arising on the photoconductor drum 11 during electrical discharge by the charging device 12, and additives to toner. It is to be noted that, in Embodiment 1, the cleaning blade 14*a* contacts or abuts the photoconductor drum 11 in the direction counter to the direction of rotation of the photoconductor drum 11.

The cleaning roller 14*b* is a brush roller including a metal shaft (a core bar) and bristles winding around the metal shaft. As the cleaning roller 14*b* rotates counterclockwise in FIG. 2, driven by a driver, the bristles slide on the surface of the photoconductor drum 11. Then, the substance such as toner and dust adhering to the surface of the photoconductor drum 11 is mechanically scraped off and collected in the cleaning device 14. The cleaning roller 14*b* is disposed upstream from the cleaning blade 14*a* in the direction of rotation of the photoconductor drum 11 to complement the cleaning by the cleaning blade 14*a*.

The cleaning device 14 serves as the device disposed opposing an image bearer (the photoconductor drum 11) and including a roller.

Figure 3:
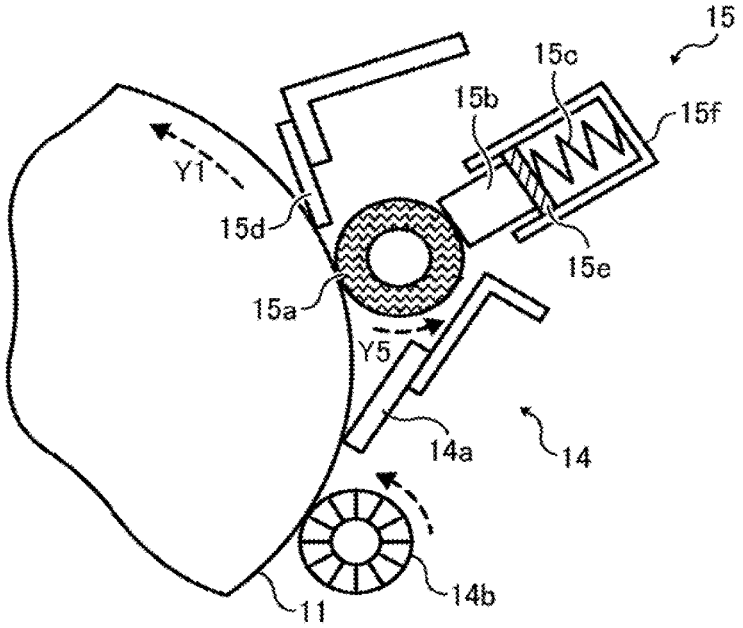
FIG. 3 is an enlarged view of a lubricant supply device and a cleaning device according to Embodiment 1.

Referring to FIGS. 2 and 3, the lubricant supply device 15 includes a solid lubricant 15*b*, a lubricant supply roller 15*a* to slidingly contact both the solid lubricant 15*b* and the photoconductor drum 11 to supply lubricant to the photoconductor drum 11, a compression spring 15*c* serving as a lubricant biasing member to bias the solid lubricant 15*b* to the lubricant supply roller 15*a*, and a leveling blade 15*d* to contact or abut against the photoconductor drum 11 to level the lubricant supplied to the photoconductor drum 11 into a thin layer. The lubricant supply roller 15*a* includes an elastic layer that slidingly contacts the photoconductor drum 11. The lubricant supply device 15 further includes a lubricant support 15*e* (a support plate) to support the solid lubricant 15*b* and a lubricant guide 15*f* (i.e., a lubricant holder) to guide the solid lubricant 15*b* supported by the lubricant support 15*e*.

The lubricant supply device 15 is disposed downstream from the cleaning device 14 (the cleaning blade 14*a* in particular) and upstream from the charging device 12 in the direction of rotation of the photoconductor drum 11. The leveling blade 15*d* is disposed downstream from the lubricant supply roller 15*a* in the direction of rotation of the photoconductor drum 11.

The lubricant supply roller 15*a* is a roller including a metal shaft 15*a*1 (i.e., a core bar) and an elastic foam layer made of, for example, polyurethane foam (urethane foam) overlying the metal shaft. With the elastic foam layer kept in contact with the surface of the photoconductor drum 11, the lubricant supply roller 15*a* rotates counterclockwise in FIG. 2 (indicated by arrow Y3). With this structure, the lubricant is supplied from the solid lubricant 15*b* via the lubricant supply roller 15*a* to the photoconductor drum 11.

For example, the lubricant supply roller 15*a* is manufactured as follows. Preliminarily shape a raw material (urethane foam) into a block to be used as the elastic foam layer. Cut the block to a suitable shape, polish the surface of the block, insert a core (made of metal) therein, and shape the urethane foam into a roller. While rotating the polyurethane foam roller, move a polishing blade on the polyurethane foam roller in a direction parallel to the axial direction of the roller so that the roller is ground to a predetermined sponge thickness (traverse grinding). To enhance adhesiveness of the core bar to the elastic foam layer, adhesive can be preliminarily applied to the core bar. Additionally, when the speed at which the polyurethane foam roller is rotated or moved can be changed in traverse grinding, irregular unevenness can be created on the surface of the elastic foam layer.

It is to be noted that, the method of manufacturing the lubricant supply roller 15*a* is not limited to the method described above. For example, in another method, urethane foam as a raw material is put in a mold containing a core bar and hardened.

The lubricant supply roller 15*a* is rotated in the direction counter to the photoconductor drum 11 rotating counterclockwise in FIG. 2. That is, the lubricant supply roller 15*a* rotates counterclockwise in FIG. 2. In other words, at the position where the lubricant supply roller 15*a* slides on the photoconductor drum 11, the lubricant supply roller 15*a* rotates in the direction opposite to the direction of rotation of the photoconductor drum 11.

The lubricant supply roller 15*a* is disposed to slidingly contact both of the solid lubricant 15*b* and the photoconductor drum 11. While rotating, the lubricant supply roller 15*a* scrapes lubricant from the solid lubricant 15*b* and applies the lubricant to the photoconductor drum 11.

On the back side of the solid lubricant 15*b* (the lubricant support 15*e*) opposite the lubricant supply roller 15*a*, the compression spring 15*c* is disposed to inhibit uneven contact between the lubricant supply roller 15*a* and the solid lubricant 15*b*. The compression spring 15*c* presses the solid lubricant 15*b* to the lubricant supply roller 15*a*.

It is to be noted that a driven coupling 15*w* (illustrated in FIGS. 4 and 6) is disposed on the shaft 15*a*1 at one axial end of the lubricant supply roller 15*a*, and the driven coupling 15*w* engages with a driving coupling 91 (illustrated in FIG. 13) disposed on a motor shaft of a driving motor 90 disposed in the body of the image forming apparatus 1 (i.e., an apparatus body). From the driving coupling 91 (the driving motor 90) of the apparatus body, a driving force is input (transmitted) to the driven coupling 15*w*, and the lubricant supply roller 15*a* rotates in the predetermined direction. The driven coupling 15*w* includes two claws disposed at different phases (in particular, shifted by 180 degrees) from each other.

In producing the solid lubricant 15*b*, inorganic lubricant is mixed in fatty acid metal zinc. Of various types of fatty acid metal zinc, a fatty acid metal zinc including at least zinc stearate is preferable. It is also preferable that the inorganic lubricant include at least one of talc, mica, and boron nitride.

Zinc stearate is a typical lamellar crystal powder. Lamellar crystals have a layer structure including self-organization of an amphiphilic molecule, and the crystal is broken easily along junctures between layers and becomes slippery receiving shearing force. Accordingly, friction on the surface of the photoconductor drum 11 can be reduced. That is, the surface of the photoconductor drum 11 can be coated effectively with a small amount of lubricant by lamellar crystals that cover the surface of the photoconductor drum 11 uniformly upon a shearing force. The surface of the photoconductor drum 11 can be coated relatively uniformly to protect the photoconductor drum 11 from electrical stress in the charging process.

Use of the inorganic lubricant having a planar structure, such as talc, mica, and boron nitride, is advantageous in inhibiting the toner and the lubricant from escaping from the cleaning device 14 (the cleaning blade 14*a*) and accordingly protecting the charging device 12 from contamination.

Additionally, in Embodiment 1, to manufacture the solid lubricant 15*b*, powder (raw material) is melted, put in a mold, and compressed. Then, the melted material solidifies and has a rectangular shape or a shape similar thereto. Such a manufacturing method is advantageous in simplifying manufacturing equipment, thereby reducing component cost.

The leveling blade 15*d* is made of rubber, such as urethane rubber, and is disposed to contact the photoconductor drum 11 at a predetermined angle with a predetermined pressure. The leveling blade 15*d* is disposed downstream from the cleaning blade 14*a* in the direction of rotation of the photoconductor drum 11. The leveling blade 15*d* levels off the lubricant on the photoconductor drum 11, which is supplied by the lubricant supply roller 15*a*, to a suitable amount uniformly.

The lubricant supply roller 15*a* supplies powdered lubricant to the photoconductor drum 11 from the solid lubricant 15*b*. However, the lubricant in this state does not exhibit sufficient lubricity. The leveling blade 15*d* makes the powdered lubricant into a thin layer and distributes the lubricant uniformly on the photoconductor drum 11. When the lubricant is leveled by the leveling blade 15*d* and becomes a coating on the photoconductor drum 11, the lubricant can fully exhibit lubricity.

In Embodiment 1, the leveling blade 15*d* contacts or abuts on the photoconductor drum 11 in the direction counter to the direction of rotation of the photoconductor drum 11. The leveling blade 15*d* contacts the photoconductor drum 11 at a pressure of about 10 g/cm to 60 g/cm and at a contact angle θ of about 75 to 90 degrees. When the leveling blade 15*d* contacts the photoconductor drum 11 in the counter direction, the thin layer of lubricant is efficiently formed on the photoconductor drum 11.

The term "contact angle θ" used here is an angle between a virtual line passing an edge of the leveling blade 15*d* and a line (perpendicular to a normal line) tangential to the contact position between the leveling blade 15*d* and the photoconductor drum 11 in a state in which the leveling blade 15*d* abuts on the photoconductor drum 11 and is bent.

Since the cleaning device 14 according to Embodiment 1 includes separate blades (the cleaning blade 14*a* and the leveling blade 15*d*) for cleaning and lubrication, good cleaning performance and good lubrication performance are attained. Additionally, wear of the cleaning blade 14*a* and the leveling blade 15*d* are alleviated by the lubricant on the photoconductor drum 11.

In Embodiment 1, the surfaces (portions to abut on the photoconductor drum 11) of the cleaning blade 14*a* and the leveling blade 15*d* are coated with an abrasion-resistive material (e.g., a fluororesin coating). Thus, abrasion of the cleaning blade 14*a* and the leveling blade 15*d* is alleviated, and the durability thereof is enhanced.

Figure 4:
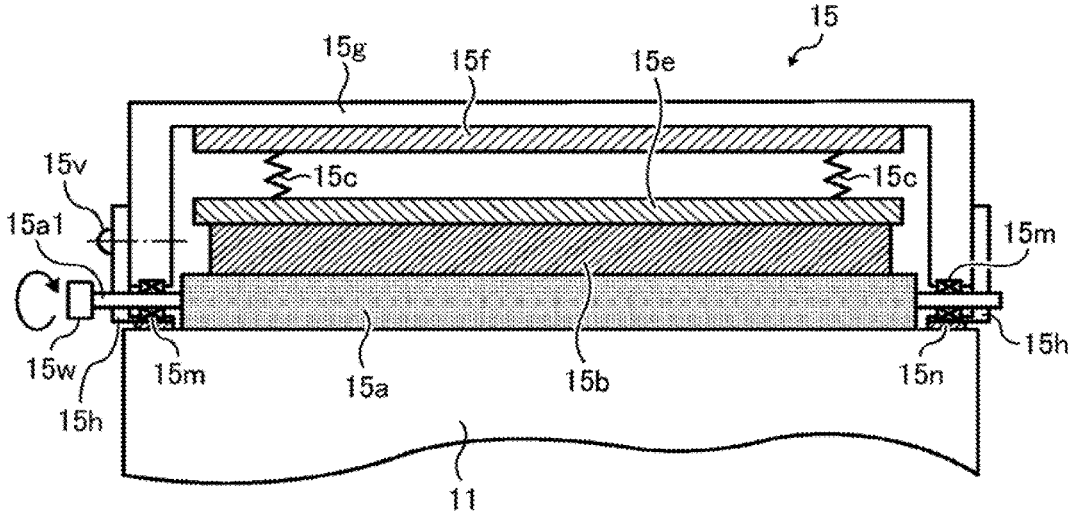
FIG. 4 is a schematic view of the lubricant supply device as viewed along an axial direction of a lubricant supply roller (i.e., a width direction)

Referring to FIGS. 3 and 4, the lubricant support 15*e* is plate-shaped and supports the solid lubricant 15*b* attached to one side of the lubricant support 15*e*.

The lubricant guide 15*f* (i.e., the lubricant holder) is shaped like a box to contain a portion of the solid lubricant 15*b*, the lubricant support 15*e*, and the compression spring 15*c*. The lubricant guide 15*f* is designed so that the lubricant support 15*e* slides on the inner faces of the lubricant guide 15*f*. One end of the compression spring 15*c* is connected to a bottom face (i.e., a closed end face on the upper side in FIG. 3) of the lubricant guide 15*f*, and the other end of the compression spring 15*c* is connected to the lubricant support 15*e*. As the solid lubricant 15*b* is consumed, the lubricant support 15*e* slidingly moves, biased by the compression spring 15*c* and guided by the lubricant guide 15*f*. Then, the solid lubricant 15*b* is pushed by the lubricant supply roller 15*a*.

The lubricant supply device 15 serves as the device disposed opposing the photoconductor drum 11 (the image bearer) and includes a roller.

In the lubricant supply device 15 according to Embodiment 1, the lubricant supply roller 15*a* is rotatably supported via a ball bearing 15*m* (i.e., a rolling bearing), which is described in detail later with reference to FIGS. 4 and 5.

The image forming processes are described in further detail below with reference to FIG. 2.

The developing roller 13*a* rotates in the direction indicated by arrow Y2 illustrated in FIG. 2. In the developing device 13, as the first and second conveying screws 13*b* and 13*c*, arranged via the partition, rotate, the developer G is circulated in the longitudinal direction of the developing device 13, being stirred with fresh toner supplied from a toner supply section 30. The longitudinal direction of the developing device 13 is perpendicular to the surface of the paper on which FIG. 2 is drawn.

The toner T is electrically charged through friction with the carrier CA and attracted to the carrier CA. The toner is carried on the developing roller 13*a* together with the carrier CA. The developer G carried on the developing roller 13*a* reaches the doctor blade 13*d*. The amount of the developer G on the developing roller 13*a* is adjusted to a suitable amount by the doctor blade 13*d*, after which the developer G is carried to the developing range facing the photoconductor drum 11.

In the developing range, the toner T in the developer G adheres to the electrostatic latent image on the photoconductor drum 11. More specifically, the electrical potential in an image area, to which the laser beam L is directed to form the latent image (exposure potential), is different from that of the developing bias applied to the developing roller 13*a* (developing potential). The difference in electrical potential generates an electrical field, with which the toner T is attracted to the latent image.

Subsequently, most of the toner T adhering to the photoconductor drum 11 in the developing process is transferred to the intermediate transfer belt 17, and the untransferred toner remaining on the surface of the photoconductor drum 11 is collected in the cleaning device 14 by the cleaning blade 14*a* and the cleaning roller 14*b*. Subsequently, the surface of the photoconductor drum 11 passes through the lubricant supply device 15 and the discharge device sequentially. Then, a sequence of image forming processes completes.

The toner supply section 30 of the apparatus body includes a replaceable toner bottle 31 and a toner hopper 32. The toner hopper 32 holds and drives the toner bottle 31, and supplies fresh toner to the developing device 13. Each toner bottle 31 contains fresh toner T (yellow toner in FIG. 2). On an inner face of the toner bottle 31, a spiral-shaped protrusion is disposed.

The fresh toner T contained in the toner bottle 31 is supplied through a toner supply inlet to the developing device 13 as the toner T in the developing device 13 is consumed. The consumption of the toner T in the developing device 13 is detected either directly or indirectly using a reflective photosensor positioned facing the photoconductor drum 11 and a magnetic sensor disposed below the second conveying screw 13*c*.

Next, descriptions are given below of the configuration and operation of the lubricant supply device 15 (i.e., a lubrication device) according to Embodiment 1.

As illustrated in FIGS. 2 and 3, the lubricant supply device 15 includes the lubricant supply roller 15*a*, which is a roller that rotates in the predetermined direction while contacting the surface of the photoconductor drum 11 (the image bearer).

Figure 5:
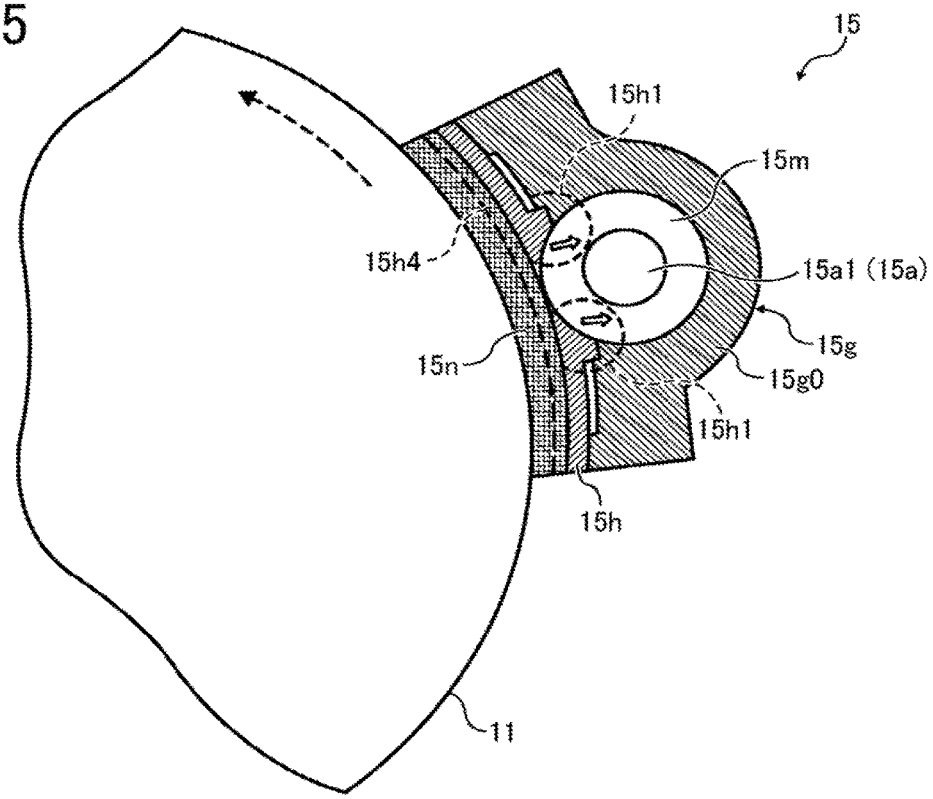
FIG. 5 is an enlarged cross-sectional view of an axial end portion of the lubricant supply device illustrated in FIG. 4.
Figure 6:
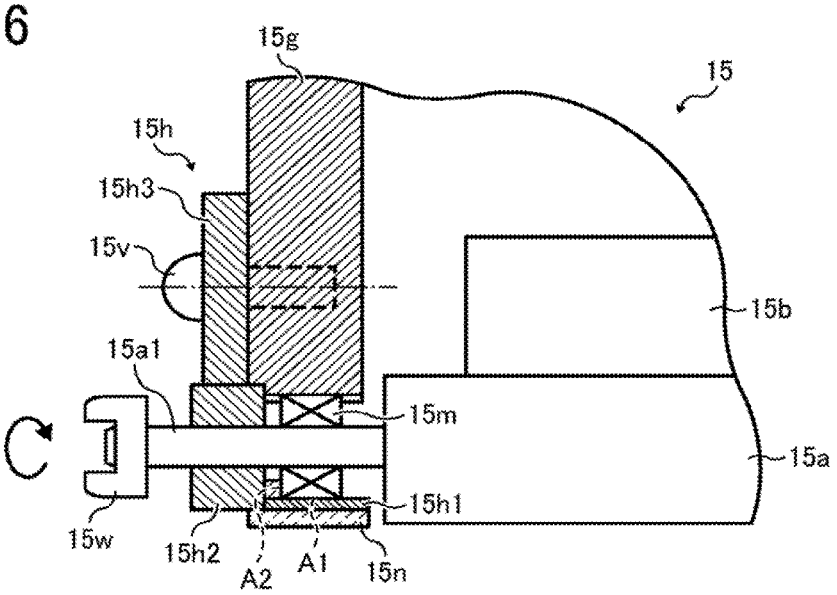
FIG. 6 is an enlarged view of the axial end portion of the lubricant supply.

In the lubricant supply device 15 according to Embodiment 1, as illustrated in FIG. 4, the ball bearing 15*m* serving as the rolling bearing is inserted (by press fit) into at least one end of the lubricant supply roller 15*a* in the axial direction of the lubricant supply roller 15*a* (i.e., a width direction, which is a lateral direction in FIGS. 4 and 6 and perpendicular to the surface of the paper on which FIG. 2 or 5 is drawn). In FIG. 4, the lubricant supply device 15 includes two ball bearings 15*m* respectively inserted into the shafts 15*a*1 located at both ends of the lubricant supply roller 15*a*. The lubricant supply roller 15*a* is supported via the ball bearing 15*m* (or the ball bearings 15*m*) by the lubricant supply device 15.

With this configuration, the ball bearing 15*m* absorbs the vibration caused by the lubricant supply roller 15*a* rotating while sliding with both of the lubricant supply roller 15*a* and the photoconductor drum 11. Specifically, the ball bearing 15*m* includes an outer ring 15*m*1, an inner ring 15*m*2, and a ball 15*m*3 (i.e., a rolling element) interposed between the inner ring 15*m*2 and the outer ring 15*m*1 so that the ball 15*m*3 contacts the outer ring 15*m*1 at a point. The ball 15*m*3 converts most of the vibration transmitted from the shaft 15*a*1 of the lubricant supply roller 15*a* to the inner ring 15*m*2 of the ball bearing 15*m* into rotation energy. Thus, the ball 15*m*3 shuts off the transmission of the vibration to the outer ring 15*m*1. Accordingly, a portion (e.g., a frame 15*g* and a bearing support 15*h*) of the housing of the lubricant supply device 15 that contacts the outer ring 15*m*1 of the ball bearing 15*m* rarely vibrate, and the vibration is not propagated to the photoconductor drum 11. Therefore, the ball bearing 15*m* alleviates image failure, such as cyclic streaks, caused by the vibration of the lubricant supply roller 15*a*.

Figure 12:
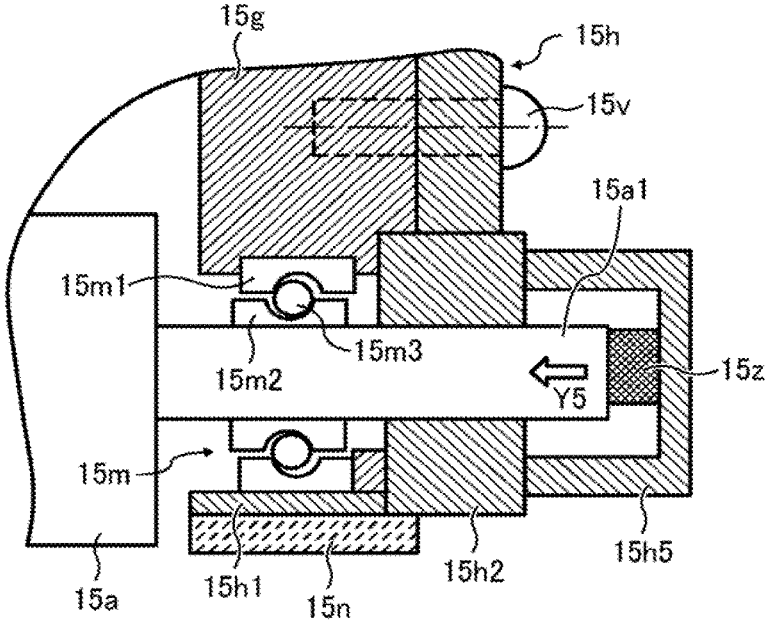
FIG. 12 is an enlarged view of an end portion of a lubricant supply device according to Embodiment 2.

Although the ball bearing 15*m* is used as the rolling bearing to hold the lubricant supply roller 15*a* in Embodiment 1, alternatively, the rolling bearing can be a roller bearing, a needle bearing, a conical roller bearing, a spherical roller bearing, or the like. Since the area of contact of the ball 15*m*3 with the inner ring 15*m*2 and the outer ring 15*m*1 is small, an inner structure of the ball bearing 15*m* is suitable to shut off the transmission of the vibration from the inner ring 15*m*2 to the outer ring 15*m*1. The structures of the outer ring 15*m*1, the inner ring 15*m*2, and the ball 15*m*3 of the ball bearing 15*m* are illustrated in FIG. 12.

Referring to FIGS. 4 and 5, in Embodiment 1, the bearing support 15*h* is removably disposed at a portion of the frame 15*g* of the lubricant supply device 15 close to the photoconductor drum 11. In Embodiment 1, the frame 15*g* is made of resin and united with a frame (or an outer case) of the process cartridge 10Y, or the frame 15*g* and the frame of the process cartridge 10Y are formed as a single part. The bearing support 15*h* is made of resin and holds the ball bearing 15*m* from the side of the outer ring 15*m*1 (i.e., an outer-rig side), keeping the ball bearing 15*m* between the bearing support 15*h* and the frame 15*g*.

Specifically, as illustrated in FIG. 5, the frame 15*g* includes an arc portion 15*g*0 shaped like an arc conforming to the outer ring 15*m*1 of the ball bearing 15*m*. The arc portion 15*g*0 contacts the outer ring 15*m*1 of the ball bearing 15*m*. In other words, the frame 15*g* includes a U-shaped portion conforming to the shape of the ball bearing 15*m* to hold the ball bearing 15*m*.

Figure 7:
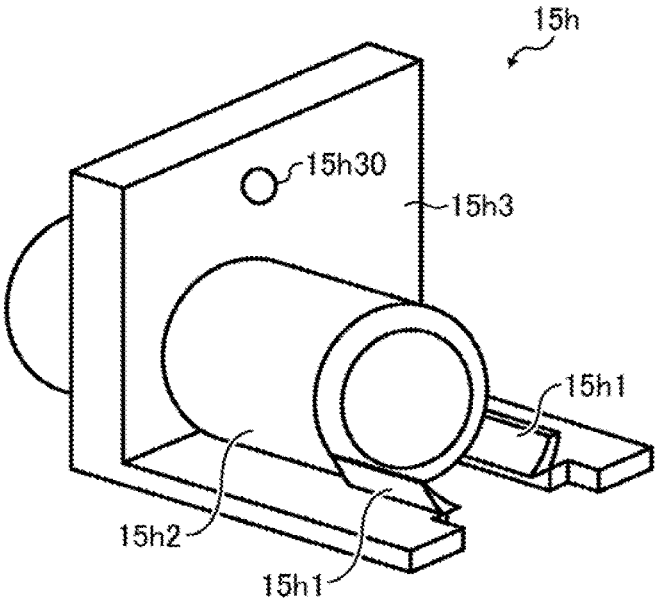
FIG. 7 is a perspective view of a bearing support of the lubricant supply device according to Embodiment 1.

By contrast, the bearing support 15*h* is made of resin and, as illustrated in FIGS. 5 through 7, includes two receiving portions 15*h*1 to hold the ball bearing 15*m* and a plain bearing portion 15*h*2. The receiving portions 15*h*1 (i.e., arc-shaped portions) are shaped like arcs to contact the surface of the outer ring 15*m*1 of the ball bearing 15*m* (surface contact). The plain bearing portion 15*h*2 is at the outer circumference of the bearing support 15*h* and is shaped to fit the frame 15*g*. In a state in which the ball bearing 15*m* is fitted in the U-shaped portion of the frame 15*g*, the bearing support 15*h* is fitted in the frame 15*g* such that the bearing support 15*h* contacts the ball bearing 15*m*. Then, the ball bearing 15*m* is supported by the lubricant supply device 15.

With this configuration, the position of the lubricant supply roller 15*a* relative to the lubricant supply device 15 (the frame 15*g* in particular) is determined with a relatively high degree of accuracy. This configuration facilitates attachment and removal of the lubricant supply roller 15*a* from the lubricant supply device 15 (the frame 15*g* in particular). Thus, maintenance of the lubricant supply roller 15*a* in the lubricant supply device 15 is improved.

In the bearing support 15*h* according to Embodiment 1, referring to FIGS. 5 through 7, the receiving portions 15*h*1 that contact the outer ring 15*m*l of the ball bearing 15*m* (i.e., the rolling bearing) are configured to exert a biasing force toward the frame 15*g*, in the direction in which the ball bearing 15*m* is sandwiched. Specifically, the receiving portions 15*h*1, serving as elastic portions in the bearing support 15*h*, bias the ball bearing 15*m* in the direction indicated by outlined arrow in FIG. 5 to enhance tight contact between the ball bearing 15*m* and the receiving portions 15*h*1 and tight contact between the ball bearing 15*m* and the arc portion 15*g*0 of the frame 15*g*.

This configuration inhibits creation of gaps between the frame 15*g* and the bearing support 15*h* (in an area A2 in FIG. 6) and gaps between the ball bearing 15*m* and the bearing support 15*h* (in an area A1 in FIG. 6). Although the gaps in the areas A1 and A2 allow the ball bearing 15*m* to vibrate up and down within the gaps in FIG. 6 as the lubricant supply roller 15*a* rotates, such vibration are inhibited in the present embodiment. The vibration of the ball bearing 15*m* makes the rotation of the lubricant supply roller 15*a* uneven, causing fluctuations in the load on the photoconductor drum 11 and making the density of the toner image on the photoconductor drum 11 uneven. The biasing attained by the receiving portions 15*h*1 can inhibit such an inconvenience.

More specifically, referring to FIGS. 6 and 7, the shaft 15*a*1 of the lubricant supply roller 15*a* is fitted in the plain bearing portion 15*h*2 of the bearing support 15*h*, and the plain bearing portion 15*h*2 fits with the frame 15*g*. Further, the plain bearing portion 15*h*2 includes a screw mounting plate 15*h*3 serving as a face to contact a side face of the frame 15*g*. The screw mounting plate 15*h*3 is screwed on the frame 15*g*.

In the bearing support 15*h*, the receiving portions 15*h*1 are configured to elastically deform, starting from the boundary of the plain bearing portion 15*h*2, which is a main part of the bearing support 15*h*. The elastic deformation of the receiving portions 15*h*1 exerts an elastic force to bias the ball bearing 15*m* upward in FIG. 6 (in the direction indicated by outlined arrow in FIG. 5), thus enhancing the tight contact between the ball bearing 15*m* and the receiving portions 15*h*1 and the tight contact between the ball bearing 15*m* and the arc portion 15*g*0 of the frame 15*g*. With the elastic force exerted by the receiving portions 15*h*1, the ball bearing 15*m* is sandwiched between the receiving portions 15*h*1 of the bearing support 15*h* and the frame 15*g* without gaps.

In Embodiment 1, the receiving portions 15*h*1 are designed to bite in the ball bearing 15*m* by about 0.1 mm to 0.3 mm when it is assumed that the receiving portions 15*h*1 do not elastically deform. That is, the amount by which the receiving portions 15*h*1 bite in the ball bearing 15*m* is set as the elastic force of the receiving portions 15*h*1.

Referring to FIGS. 5 and 7, in Embodiment 1, the two receiving portions 15*h*1 of the bearing support 15*h* are spaced in an arc direction following the outer ring 15*m*l of the ball bearing 15*m* and shaped like arcs following the outer ring 15*m*1. As illustrated in FIG. 7, the receiving portions 15*h*1 rise from the boundary of the plain bearing portion 15*h*2.

In the present embodiment, the amount (i.e., a lateral length in FIG. 6) by which the receiving portion 15*h*1 projects from the boundary of the plain bearing portion 15*h*2 is about 5 mm to 6 mm. The length (i.e., a lateral length in FIG. 6) of the receiving portion 15*h*1 extending from the boundary of the plain bearing portion 15*h*2 to the ball bearing 15*m* is about 1 mm to 2 mm.

Further, referring to FIGS. 6 and 7, the receiving portions 15*h*1 are made thinner than the plain bearing portion 15*h*2 (including the screw mounting plate 15*h*3 and excluding the receiving portions 15*h*1). The thickness of the receiving portions 15*h*1 is preferably not greater than 2 mm and more preferably not greater than 1.5 mm. In the present embodiment, the thickness of the plain bearing portion 15*h*2 is greater than or equal to 2 mm.

Having such a relatively thin thickness, the receiving portions 15*h*1 serve as the elastic portions to bias the ball bearing 15*m*. When the thickness of the plain bearing portion 15*h*2 (the portion except the receiving portions 15*h*1) is relatively large, the plain bearing portion 15*h*2 serves as a rigid portion to support the receiving portions 15*h*1.

Referring to FIG. 6, the bearing support 15*h* is screwed to the frame 15*g*.

Specifically, the screw mounting plate 15*h*3 of the bearing support 15*h* includes a screw hole 15*h*30 (illustrated in FIG. 7), and a screw 15*v* is screwed via the screw hole 15*h*30 into a female screw in the side face of the frame 15*g*.

With the screwing, the plain bearing portion 15*h*2 (and the screw mounting plate 15*h*3), which is the rigid portion of the bearing support 15*h*, is reliably secured to the frame 15*g*. Then, the screwing enhances the effect of the elasticity of the receiving portion 15*h*1 to inhibit the ball bearing 15*m* from vibrating.

It is to be noted that, in Embodiment 1, as illustrated in FIG. 4, one ball bearing 15*m* (the rolling bearing) and one bearing support 15*h* are disposed at each axial end of the lubricant supply roller 15*a*. Of the two bearing supports 15*h*, the one disposed on the driving side (on the left in FIG. 4), to which the driving force to rotate the lubricant supply roller 15*a* is input, is screwed to the frame 15*g*, as illustrated in FIG. 6. Specifically, the other bearing support 15*h* (on the right in FIG. 4, which is a driven side) is not screwed with the screw 15*v*, and the position of the bearing support 15*h* on the driven side is determined by the fitting of the bearing support 15*h* in the frame 15*g*.

When a gap is present between the frame 15*g*, the bearing support 15*h*, and the ball bearing 15*m*, the vibration of the ball bearing 15*m* inside the gap is more likely to occur on the driving side close to the driver than the driven side.

Referring to FIG. 5 and the like, in Embodiment 1, an end of the arc portion 15*g*0 (a U-shaped portion) of the frame 15*g* is chamfered by either C chamfering (e.g., chamfering at 45 degrees) or R chamfering (round chamfering). The end portion of the arc portion 15*g*0 is the boundary of the ball bearing 15*m* fitted therein. The chamfering facilitates attachment of the ball bearing 15*m* to the frame 15*g*.

Referring to FIG. 5, a seal 15*n* made of an elastic material such as polyurethane foam and implanted fibers is disposed between the bearing support 15*h* and the photoconductor drum 11, to eliminate clearance therebetween. The seal 15*n* has a thickness of about 0.5 mm to 3 mm and bonded to a bonding face 15*h*4 of the bearing support 15*h*, which faces the photoconductor drum 11 and is indicated by alternate long and short dashed lines in FIG. 5. The seal 15*n* prevents the scattering of lubricant outside the lubricant supply device 15 (areas not to be lubricated). Further, the seal 15*n* serves as a buffer to inhibit the vibration arising in the lubricant supply device 15 from being transmitted to the photoconductor drum 11, thereby securing the effect to inhibit the image failure such as streaks. Yet further, the seal 15*n* serves as an elastic portion, together with the receiving portion 15*h*1, to bias the ball bearing 15*m* to the frame 15*g*, thereby securing the effect to inhibit the vibration of the ball bearing 15*m*.

To reduce the sliding friction between the seal 15*n* and the photoconductor drum 11, the surface of the seal 15*n* opposing the photoconductor drum 11 can be provided with a low friction coating. Alternatively, a low friction material such as a piece of mylar can be bonded to the seal 15*n*.

In Embodiment 1, as described above with reference to FIG. 6, the bearing support 15*h* is screwed to the frame 15*g*, from the lateral side in FIG. 6 (from one end side in the axial direction of the lubricant supply roller 15*a*).

Figure 8:
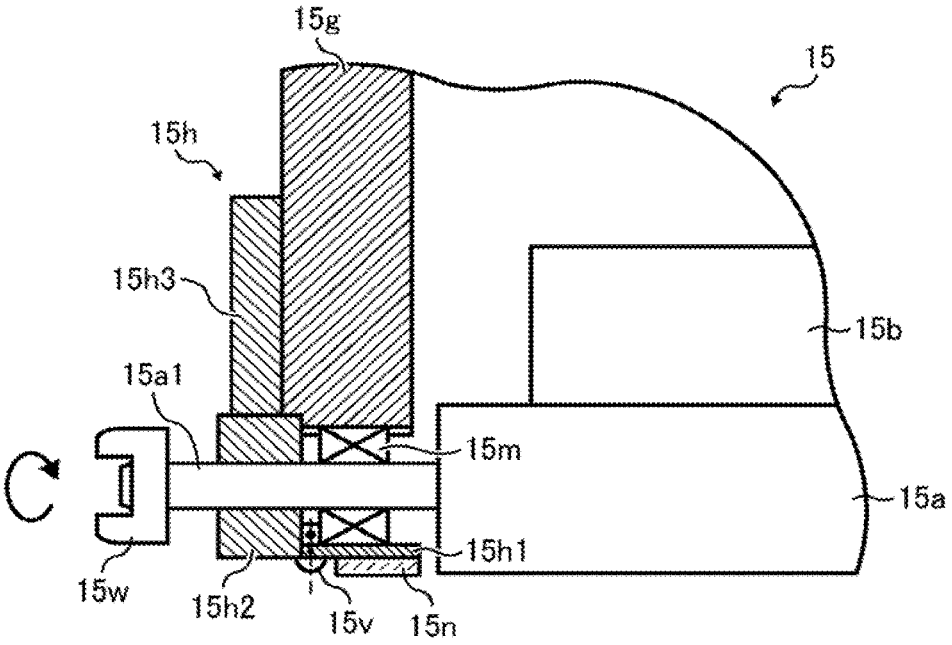
FIG. 8 is an enlarged view of an end portion of a variation of the lubricant supply device according to Embodiment 1.

Alternatively, as illustrated in FIG. 8, the bearing support 15*h* can be screwed to the frame 15*g* in the direction in which the ball bearing 15*m* is sandwiched between the bearing support 15*h* and the frame 15*g*.

Specifically, the screw 15*v* is inserted into a female screw in the bottom face of the frame 15*g* in FIG. 8, via a screw hole formed in the receiving portion 15*h*1 of the bearing support 15*h*.

With this configuration, the boundary of the plain bearing portion 15*h*2 in the bearing support 15*h* can be secured to the frame 15*g* more reliably, thereby enhancing the effect of the elasticity of the receiving portion 15*h*1 to inhibit the ball bearing 15*m* from vibrating.

Figure 9:
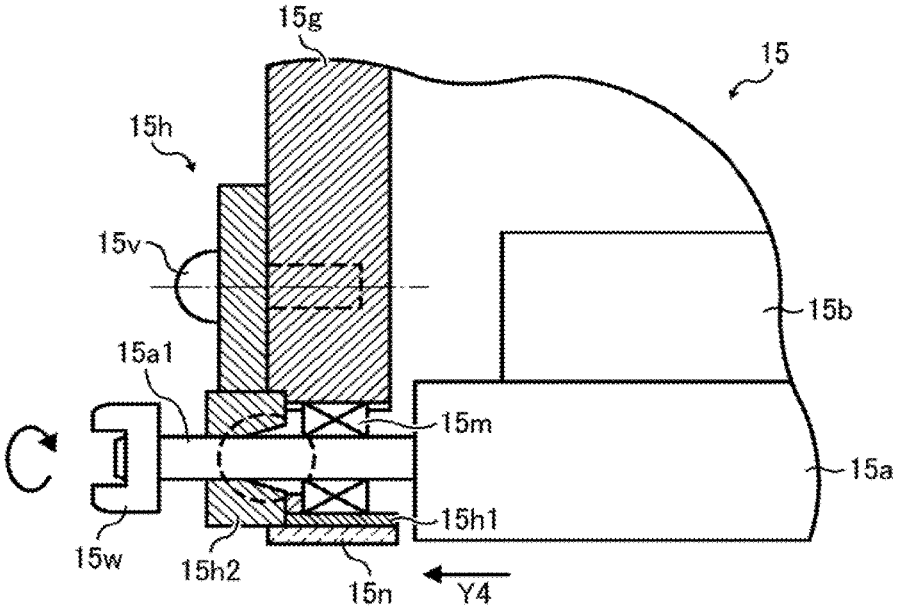
FIG. 9 is an enlarged view of an end portion of another variation of the lubricant supply device according to Embodiment 1.

Additionally, as illustrated in FIG. 9, the plain bearing portion 15*h*2 can be shaped such that an inner diameter of the plain bearing portion 15*h*2 progressively decreases in the direction indicated by arrow Y4 in FIG. 9, in which the shaft 15*a*1 is inserted therein. Then, the shaft 15*a*1 is press-fitted. Specifically, as illustrated in FIG. 9, the inner side of the plain bearing portion 15*h*2 is tapered so that the inner diameter progressively decreases from the right to the left in FIG. 9 and the smallest diameter is slightly smaller than the outer diameter of the shaft 15*a*1 to enable the press-fit.

With this configuration, the position of the shaft 15*a*1 relative to the plain bearing portion 15*h*2 in the radial direction can be determined with a high degree of accuracy, thereby enhancing the effect of the elasticity of the receiving portion 15*h*1 to inhibit the ball bearing 15*m* from vibrating.

Additionally, in Embodiment 1, the bearing support 15*h*, which is removably attached to the frame 15*g*, is disposed at each axial end, together with the ball bearing 15*m*.

Figure 10:
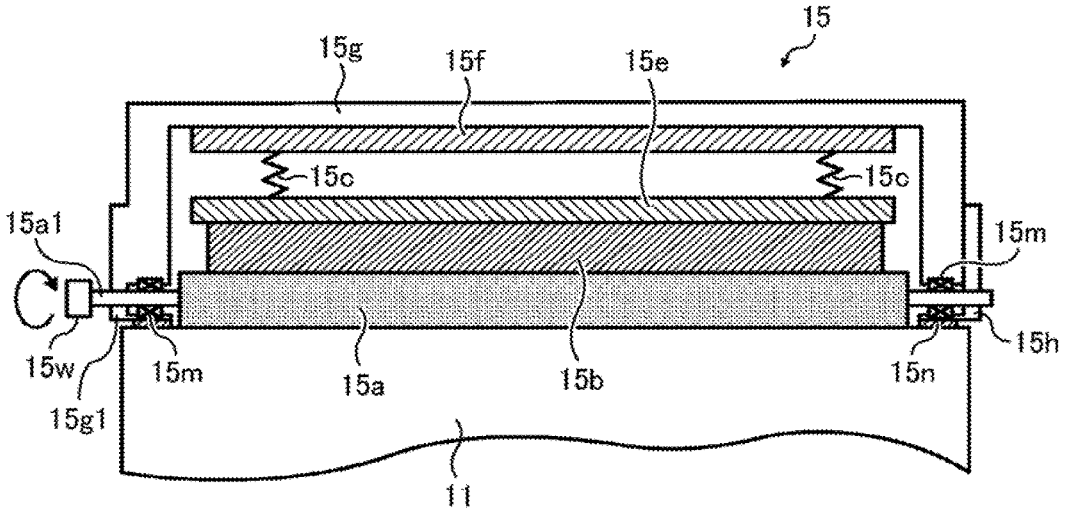
FIG. 10 is a schematic view of a lubricant supply device of yet another variation of the lubricant supply device according to Embodiment 1.

Alternatively, the bearing support 15*h* removably attached to only one end of the frame 15*g* in the axial direction of the lubricant supply roller 15*a*. Specifically, as illustrated in FIG. 10, the ball bearing 15*m* (the rolling bearing) is disposed at each axial end of the lubricant supply roller 15*a*. The bearing support 15*h* is disposed on only the axial end of the lubricant supply roller 15*a* on the driven side (on the right in FIG. 10).

Further, on the axial end on the driving side (on the left in FIG. 10), the frame 15*g* includes a bearing support portion 15*g*1 that is similar in structure to the bearing support 15*h* and is continuous with the frame 15*g* as a single part. That is, the bearing support portion 15*g*1 located on the driving side of the frame 15*g* includes a receiving portion to bias the ball bearing 15*m* in the direction in which the ball bearing 15*m* is sandwiched, similar to the bearing support 15*h*. In other words, on the driving side, the bearing support portion 15*g*1 is united to the frame 15*g* not to be removed from the frame 15*g*, while the bearing support 15*h* is removably disposed on the frame 15*g* on the driven side.

Thus, on the driving side, the component accuracy of the frame 15*g*, which is a single component including the bearing support portion 15*g*1, is enhanced to inhibit creation of gaps between the ball bearing 15*m* and the frame 15*g* (the bearing support portion 15*g*1 in particular). Accordingly, this configuration enhances the effect of the elasticity of the receiving portion 15*h*1 to inhibit the ball bearing 15*m* from vibrating. In particular, as described above, compared with the driven side, on the driving side, the ball bearing 15*m* is more likely to vibrate in the gap. Accordingly, the configuration illustrated in FIG. 10 is effective. Additionally, in the configuration illustrated in FIG. 10, the bearing support 15*h* is removable from the frame 15*g* on one side in the axial direction of the lubricant supply roller 15*a*. Accordingly, even when the bearing support portion 15*g*1 is not removable from the frame 15*g* on the other side, the lubricant supply roller 15*a* can be attached to and removed from the lubricant supply roller 15*a* (e.g., for maintenance work).

In Embodiment 1, the receiving portion 15*h*1 of the bearing support 15*h* is in direct contact with the outer ring 15*m*1 of the ball bearing 15*m*.

Figure 11A:
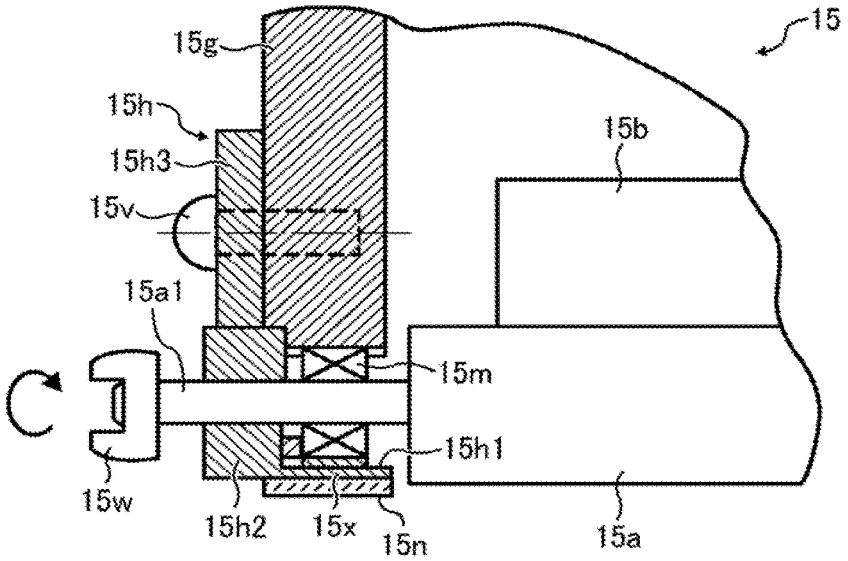
FIGS. 11A and 11B are enlarged views of an end portion of yet another variation of the lubricant supply device according to Embodiment 1.

By contrast, in another variation, as illustrated in FIG. 11A, the receiving portion 15*h*1 of the bearing support 15*h* is in indirect contact with the outer ring 15*m*1 (illustrated in FIG. 12) of the ball bearing 15*m*, via an elastic body 15*x*. That is, the elastic body 15*x* is disposed between the outer ring 15*m*1 of the ball bearing 15*m* (the rolling bearing) and the receiving portion 15h1 of the bearing support 15h screwed to the frame 15g. For the elastic body 15x, rubber or a flat spring can be used.

In this configuration, since the elastic body 15x can complement the elasticity of the receiving portion 15h1, this configuration further inhibits creation of gaps between the frame 15g and the bearing support 15h and gaps between the ball bearing 15m and the bearing support 15h. This configuration reliably inhibits the ball bearing 15m from vibrating up and down in FIG. 11A as the lubricant supply roller 15a rotates.

Figure 11B:
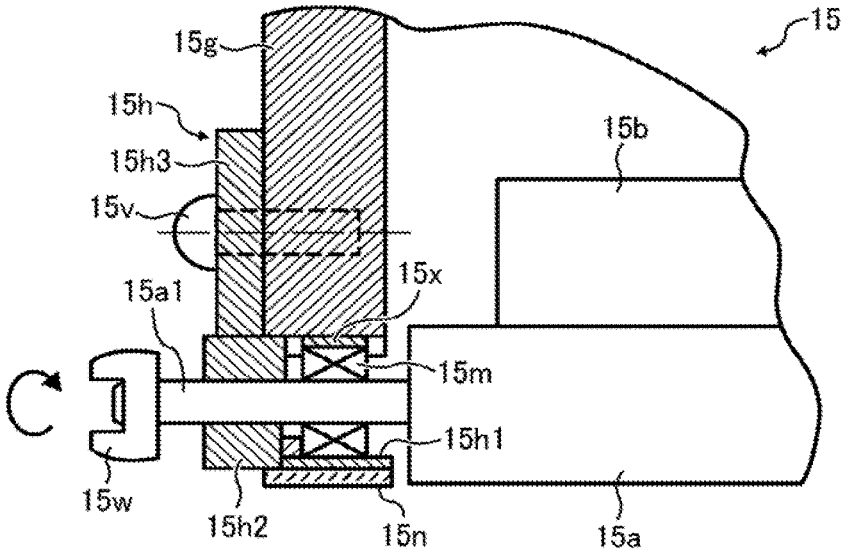

Additionally, as illustrated in FIG. 11B, a similar effect is available when the elastic body 15x is disposed between the outer ring 15m1 of the ball bearing 15m (the rolling bearing) and the frame 15g.

Figure 14:
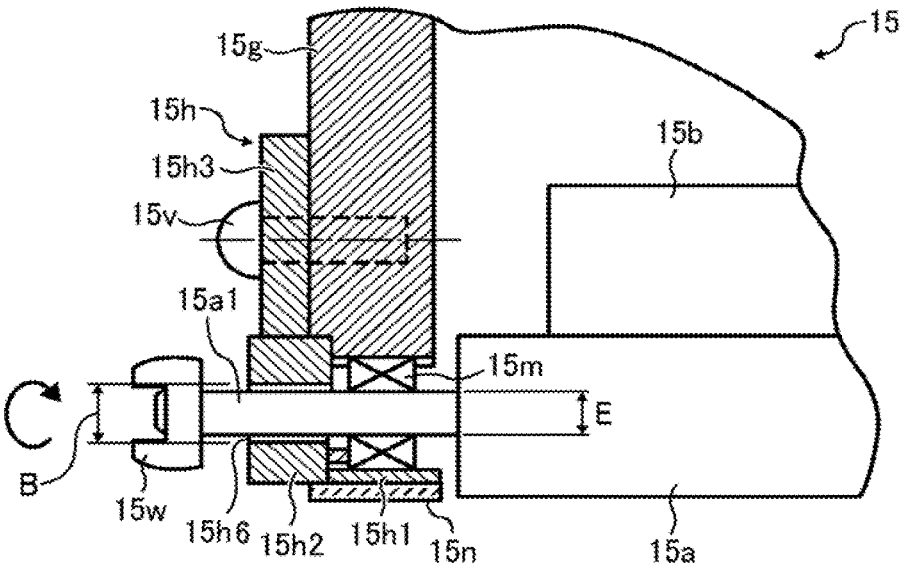
FIG. 14 is a schematic view of a lubricant supply device extending in the width direction, as yet another variation of Embodiment 1.

Additionally, as illustrated in FIG. 14, in Embodiment 1, the bearing support 15h can have a through hole 15h6 into which the shaft 15a1 of the lubricant supply roller 15a is inserted with a clearance secured.

As illustrated in FIG. 14, similar to Embodiment 1, the bearing support 15h is screwed to the frame 15g at a position away from the receiving portion 15h1. Specifically, the screw 15v penetrates the screw mounting plate 15h3 of the bearing support 15h, away from the receiving portion 15h1, and engages the frame 15g. The through hole 15h6 is disposed in the plain bearing portion 15h2 and has a hole diameter B. The through hole 15h6 is configured such that a clearance of about 0.01 mm to 0.1 mm is secured around the shaft 15a1 of the lubricant supply roller 15a. In other words, the hole diameter B of the through hole 15h6 in the plain bearing portion 15h2 is greater than a diameter E of the shaft 15a1 (B>E). Accordingly, the plain bearing portion 15h2 scarcely functions as a plain bearing.

In this configuration, since the plain bearing portion 15h2 is not firmly fitted around (supported by) the shaft 15al of the lubricant supply roller 15a, the bearing support 15h can easily deform from the boundary (i.e., a start point of deformation) between the screw mounting plate 15h3, which is in contact with the frame 15g and secured thereto with the screw 15v, and a free end portion free from contact with the frame 15g. Accordingly, the receiving portion 15h1, which is away from the start point of deformation, is sufficiently biased to contact the ball bearing 15m. Then, the clearance between the frame 15g and the bearing support 15h and the clearance between the bearing support 15h and the ball bearing 15m are inhibited or reduced, thereby suppressing vibration of the ball bearing 15m.

Additionally, compared with a configuration in which no clearance is secured in the through hole 15h6 into which the shaft 15a1 of the lubricant supply roller 15a is inserted, the range of elastic deformation of the bearing support 15h is extended. Accordingly, stress is less likely to be concentrated, thus alleviating damage and permanent distortion.

Figure 15:
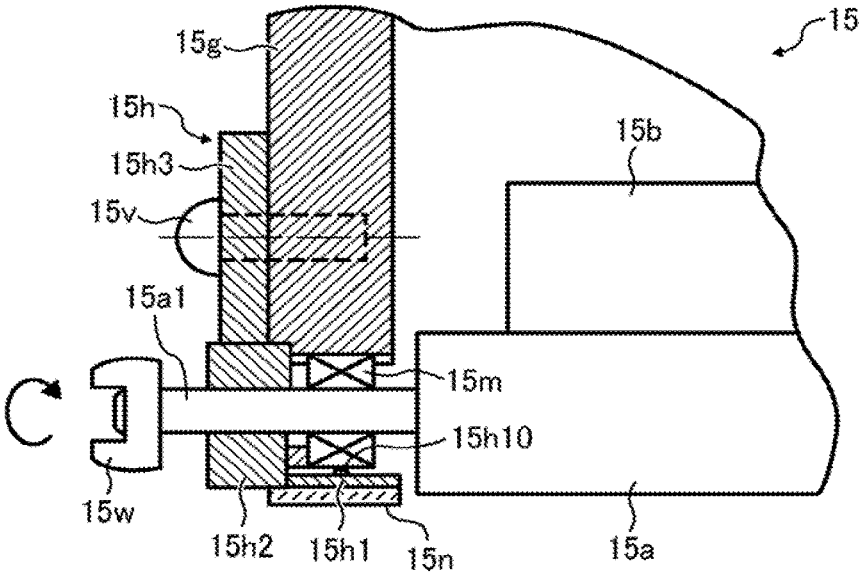
FIG. 15 is a schematic view of a lubricant supply device extending in the width direction, as yet another variation of Embodiment 1.
Figure 16:
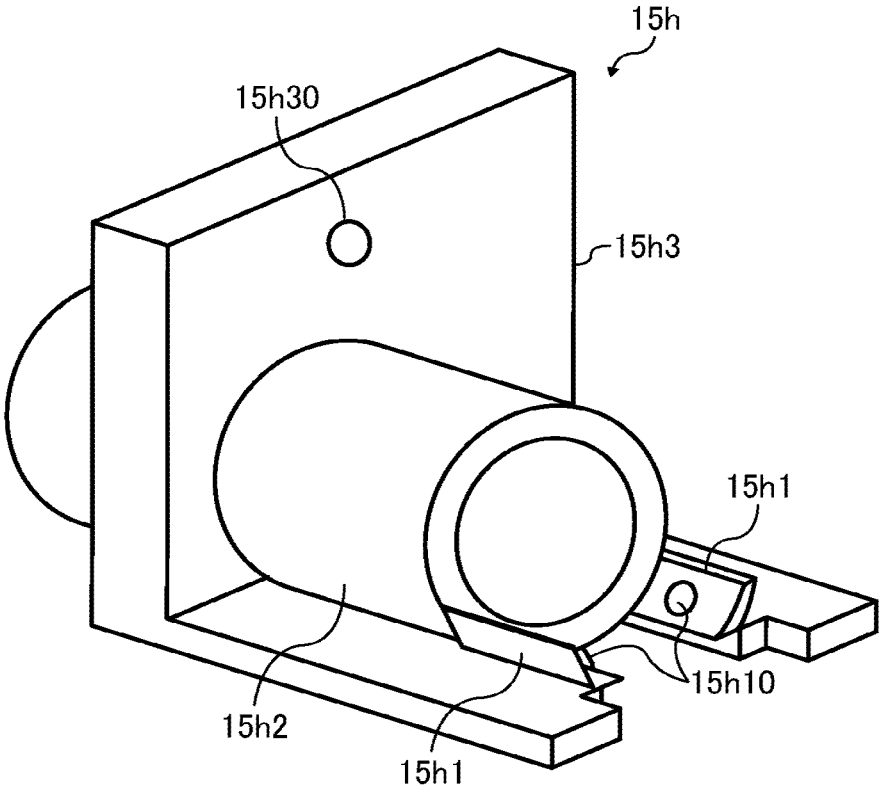
FIG. 16 is a perspective view of the bearing support of the lubricant supply device illustrated in FIG. 15.

Further, as another variation to Embodiment 1, the receiving portion 15h1 of the bearing support 15h can include projections 15h10, illustrated in FIGS. 15 and 16, to contact the outer ring 15m1 of the ball bearing 15m (i.e., the rolling bearing). The projections 15h10 are almost hemispherical.

Specifically, as illustrated in FIGS. 15 and 16, each of the two receiving portion 15h1 (raised portions) includes the hemispherical projection 15h10 projecting in the biasing direction to contact, at a point, almost a center position of the ball bearing 15m (the outer ring 15m1 in particular) in the axial direction of the lubricant supply roller 15a. That is, there is not a surface contact but a point contact between the receiving portion 15h1 and the ball bearing 15m, with the projection 15h10 serving as the point of contact.

Such a configuration can inhibit the receiving portion 15h1 from being drawn to one side to contact a corner at an end of the ball bearing 15m (the outer ring 15m1) in the axial direction of the lubricant supply roller 15a. When the receiving portion 15h1 contacts the corner at the end of the ball bearing 15m, the receiving portion 15h1 fails to bias the ball bearing 15m in the intended direction (vertically upward in FIG. 13). Further, compared with a surface contact between the receiving portion 15h1 and the ball bearing 15m, the frictional resistance between the receiving portion 15h1 and the ball bearing 15m is reduced, and the receiving portion 15h1 can efficiently bias the ball bearing 15m. Since the projection 15h10 is hemispherical, the receiving portion 15h1 can stably contact the ball bearing 15m at the point, regardless of the posture of the receiving portion 15h1, which elastically deforms to bias the ball bearing 15m.

Therefore, the clearance between the frame 15g and the bearing support 15h and the clearance between the bearing support 15h and the ball bearing 15m are inhibited or reduced better, thereby better suppressing vibration of the ball bearing 15m.

It is to be noted that, although the descriptions above concern the features of the lubricant supply device 15 serving as the device disposed opposing an image bearer and including a roller, the cleaning device 14 has similar features. Specifically, a ball bearing (i.e., a rolling bearing) is press-fitted in each axial end of the cleaning roller 14b, and the cleaning roller 14b is supported, via the ball bearing, by the cleaning device 14. Further, the frame 15g, the bearing support 15h, the seal 15n, and the like of the lubricant supply device 15 are adopted in the cleaning device 14.

With this configuration, in the cleaning device 14, effects similar to those described above are attained.

As described above, according to Embodiment 1, the ball bearing 15m is fitted to the shaft 15a1 at the axial end of the lubricant supply roller 15a (or the cleaning roller 14b) that slidingly contacts the photoconductor drum 11 (the image bearer). The bearing support 15h presses, from the outer-ring side, the ball bearing 15m to the frame 15g to hold the ball bearing 15m between the bearing support 15h and the frame 15g, and the bearing support 15h is removably attached to the frame 15g. In the bearing support 15h, the receiving portions 15h1, which contact the outer ring 15m1 of the ball bearing 15m, bias the ball bearing 15m toward the frame 15g, in the direction in which the ball bearing 15m is sandwiched between the bearing support 15h and the frame 15g.

This configuration inhibits creation of gaps between the frame 15g and the bearing support 15h and gaps between the ball bearing 15m and the bearing support 15h, thereby inhibiting the ball bearing 15m from vibrating within the gaps as the lubricant supply roller 15a (or the cleaning roller 14b) rotates.

Embodiment 2

Embodiment 2 is described below with reference to FIG. 12.

Figure 13:
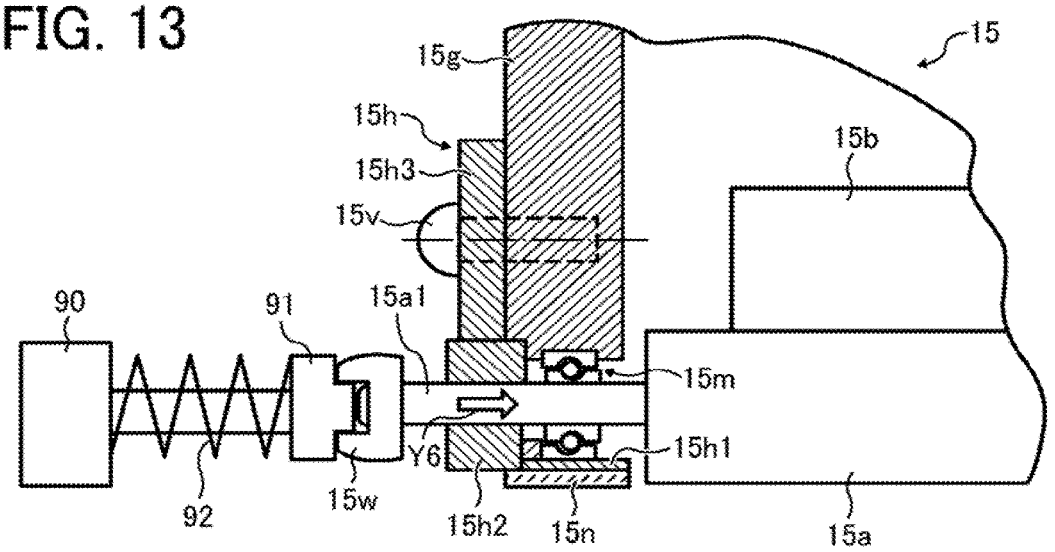
FIG. 13 is an enlarged view of an end portion of a variation of the lubricant supply device according to Embodiment 2.

FIG. 12 is an enlarged view of an end portion of a lubricant supply device in the width direction, according to Embodiment 2. FIG. 13 is an enlarged view of an end portion of a lubricant supply device in the width direction, according to a variation of Embodiment 2, and corresponds to FIG. 6 illustrating the structure according to Embodiment 1.

The lubricant supply device 15 according to Embodiment 2 is different from that according to Embodiment 1 in that the inner ring 15m2, together with the lubricant supply roller 15a, is biased in the axial direction of the lubricant supply roller 15*a* in a state in which the position of the outer ring 15*m*1 is determined to inhibit free movement of the ball 15*m*3.

In Embodiment 2, the lubricant supply device 15 includes the lubricant supply roller 15*a*, the solid lubricant 15*b*, the ball bearing 15*m*, the frame 15*g*, the bearing support 15*h*, and the like, similar to Embodiment 1. Similar to Embodiment 1, the bearing support 15*h* includes the receiving portion 15*h*1 to bias the ball bearing 15*m* upward in FIG. 12.

The ball bearing 15*m* includes the outer ring 15*m*1, the inner ring 15*m*2, and the ball 15*m*3, similar to Embodiment 1.

In the lubricant supply device 15 according to Embodiment 2, as illustrated in FIG. 12, the bearing support 15*h* is attached to the frame 15*g*, with the screw 15*v*, on the driven side opposite the driving side on which the driven coupling 15*w* connected to the driving coupling 91 (illustrated in FIG. 13). The bearing support 15*h* further includes a cover 15*h*5 to cover the shaft 15*a*1 of the lubricant supply roller 15*a*.

Referring to FIG. 12, in the ball bearing 15*m* according to Embodiment 2, the outer ring 15*m*1 contacts (fits in) the frame 15*g* to determine the position of the outer ring 15*m*1 relative to the frame 15*g* in the axial direction of the lubricant supply roller 15*a* (the lateral direction in FIG. 12). Specifically, the outer ring 15*m*1 of the ball bearing 15*m* fits in a recess of the frame 15*g* to determine the position of the outer ring 15*m*1 relative to the frame 15*g* in the axial direction.

Additionally, the inner ring 15*m*2 of the ball bearing 15*m* fits around the shaft 15*a*1 of the lubricant supply roller 15*a* to determine the position of the inner ring 15*m*2 relative to the lubricant supply roller 15*a* in the axial direction. Specifically, the inner ring 15*m*2 of the ball bearing 15*m* is press-fitted around the shaft 15*a*1 of the lubricant supply roller 15*a* to determine the position of the inner ring 15*m*2 relative to the lubricant supply roller 15*a* in the axial direction.

Referring to FIG. 12, the lubricant supply device 15 according to Embodiment 2 further includes a biasing member 15*z* to bias the inner ring 15*m*2 of the ball bearing 15*m*, together with the lubricant supply roller 15*a*, to one end (to the left in FIG. 12) in the axial direction.

The biasing member 15*z* is provided because, in a case where gaps are present between the outer ring 15*m*1 and the ball 15*m*3 or between the inner ring 15*m*2 and the ball 15*m*3, there is a risk that the ball 15*m*3 vibrates within the gap, resulting in the vibration of the ball bearing 15*m*, as the lubricant supply roller 15*a* rotates. The vibration of the ball bearing 15*m* makes the rotation of the lubricant supply roller 15*a* uneven, resulting in uneven density of the toner image on the photoconductor drum 11.

By contrast, in Embodiment 2, as illustrated in FIG. 12, being biased in the direction indicated by arrow Y5 (to the left in FIG. 12) by the biasing member 15*z*, the inner ring 15*m*2 of the ball bearing 15*m* causes the ball 15*m*3 to contact the outer ring 15*m*1 in a state in which the ball 15*m*3 is pushed in the direction indicated by arrow Y5. Accordingly, the outer ring 15*m*1 and the inner ring 15*m*2 sandwich the ball 15*m*3 therebetween in the axial direction of the lubricant supply roller 15*a* and inhibit the ball 15*m*3 from vibrating inside the ball bearing 15*m*. Accordingly, the vibration of the ball bearing 15*m* caused by the vibration of the ball 15*m*3 is reliably inhibited.

More specifically, the biasing member 15*z* is a sliding member (or an elastic body) and disposed between the bearing support 15*h* (the cover 15*h*5) and an end face of the shaft 15*a*1 of the lubricant supply roller 15*a*.

When the biasing member 15*z* is a rigid sliding member, i) a material to reduce the frictional resistance with the end face of the shaft 15*a*1 is used, and ii) the length of the biasing member 15*z* in the axial direction of the lubricant supply roller 15*a* is set such that the ball 15*m*3 15*z* reliably contacts the outer ring 15*m*1 in the state in which the ball 15*m*3 is pushed in the direction indicated by arrow Y5 by the inner ring 15*m*2 biased in that direction.

When the biasing member 15*z* is an elastic body, a rubber component or a flat spring can be used. The inner ring 15*m*2 and the lubricant supply roller 15*a* are biased by the elastic force of the elastic body serving as the biasing member 15*z*.

Alternatively, instead of the biasing member 15*z*, a spring 92 (e.g., a compression spring) illustrated in FIG. 13 can be used to bias the inner ring 15*m*2 of the ball bearing 15*m*. The spring 92 biases the driving coupling 91 engaging the driven coupling 15*w* disposed on the shaft 15*a*1 of the lubricant supply roller 15*a* in the direction indicated by arrow Y6 (hereinafter "direction Y6"), to one end (to the right in FIG. 13) in the axial direction of the lubricant supply roller 15*a*.

Specifically, the driving coupling 91 is provided, movably in the axial direction, to the motor shaft of the driving motor 90 disposed in the apparatus body. The motor shaft of the driving motor 90 is provided with the spring 92, which biases the driving coupling 91 in the direction Y6, and a retaining ring to restrict the movement of the driving coupling 91 in the direction Y6. With this configuration, when the lubricant supply device 15 is moved from the right to the left in FIG. 13 and mounted in the apparatus body, the driven coupling 15*w* of the lubricant supply device 15 engages the driving coupling 91 of the apparatus body. At that time, the spring 92 biases the inner ring 15*m*2 of the ball bearing 15*m*, together with the lubricant supply roller 15*a*, in the direction Y6 (to the right in FIG. 13) to contact the outer ring 15*m*1 in the state in which the ball 15*m*3 is pushed in the direction Y6. Accordingly, the structure illustrated in FIG. 13 attains an effect similar to the effect described with reference to FIG. 12.

This effect is ensured when the bias force of the spring 92 is set to a degree not to move the entire lubricant supply device 15 in the direction Y6. Alternatively, this effect is ensured when a stopper is provided to prevent the lubricant supply device 15 from being moved in the direction Y6 by the bias force of the spring 92.

As described above, according to Embodiment 2, in the ball bearing 15*m* fitted to the shaft 15*a*1 at the axial end of the lubricant supply roller 15*a* (or the cleaning roller 14*b*) that slidingly contacts the photoconductor drum 11 (the image bearer), the outer ring 15*m*1 contacts the frame 15*g* to determine the relative positions thereof in the axial direction of the lubricant supply roller 15*a*, and the inner ring 15*m*2 fits around the shaft 15*a*1 of the lubricant supply roller 15*a* (or the cleaning roller 14*b*) to determine the position of the inner ring 15*m*2 relative to the lubricant supply roller 15*a* (or the cleaning roller 14*b*) in the axial direction. The lubricant supply device 15 according to Embodiment 2 further includes the biasing member 15*z* (or the spring 92) to bias the inner ring 15*m*2, together with the lubricant supply roller 15*a*, to one side in the axial direction of the lubricant supply roller 15*a*.

With this configuration, even when a gap is present between the inner ring 15*m*2 (or the outer ring 15*m*1) and the ball 15*m*3, the ball bearing 15*m* is inhibited from vibrating as the lubricant supply roller 15*a* (or the cleaning roller 14*b*) rotates.

It is to be noted that, in the above-described embodiments, the cleaning device 14 and the lubricant supply device 15 are united together with the photoconductor drum 11, the charging device 12, and the developing device 13 into the process cartridge 10 (i.e., an image forming unit) to make the image forming unit compact and to facilitate maintenance work.

Alternatively, the cleaning device 14, the lubricant supply device 15, or both can be configured to be independently mounted in the apparatus body to be replaceable separately. In such a configuration, similar effects can be attained as well.

It is to be noted that the term "process cartridge" used in this disclosure means a unit that is removably mountable in the image forming apparatus and includes an image bearer and at least one of a charging device to charge the image bearer, a developing device to develop a latent image on the image bearer, a cleaning device to clean the image bearer, and a lubricant supply device.

Additionally, although the description above concerns the image forming apparatus including the developing device 13 using two-component developer, one or more of the features of the above-described embodiments can adapt to image forming apparatuses including one-component developing devices using one-component developer.

It is to be noted that, although the description above concerns the lubricant supply device 15 to lubricate the photoconductor drum 11, alternatively, one of more of the features of the above-described embodiments can adapt to a lubricant supply device to lubricate a photoconductor belt serving as an image bearer. Yet alternatively, one of more of the features of the above-described embodiments can adapt to a lubricant supply device to lubricate the intermediate transfer belt 17 serving as an image bearer and the belt cleaning device 19 to remove the untransferred toner from the intermediate transfer belt 17.

Although the lubricant supply roller 15*a* includes the elastic foam layer overlying the core bar in the above-described embodiments, alternatively, as the lubricant supply roller 15*a*, a brush roller including straight or looped bristles winding around the core bar can be used instead. As the bristles, resin fibers made of, for example, polyester, nylon, rayon, acrylic resin, vinylon, or vinyl chloride can be used, and conductive fibers in which carbon or the like is mixed to exhibit conductivity can be used as required. For example, the bristles have a bristle length of about 0.2 mm to 20 mm and a bristle density of about 20,000 F/in$^2$ to 100,000 F/in$^2$.

In such configurations, effects similar to those described above are attained when the ball bearing 15*m* (the ball bearing 15*m*) is used similar to the above-described embodiments.

Although both the lubricant supply roller 15*a* and the cleaning roller 14*b* are held via the ball bearing, serving as the rolling bearing, by the housings of the devices in the above-described embodiments, in one embodiment, only the lubricant supply roller 15*a* is held via the rolling bearing by the housing of the device. The lubricant supply roller 15*a* is particularly likely to vibrate significantly since the lubricant supply roller 15*a* slidingly contacts the photoconductor drum 11 as well as the solid lubricant 15*b*. Thus, use of the rolling bearing for the lubricant supply roller 15*a* contributes largely to inhibition of image failure in the entire image forming system.

In yet another embodiment, a charging roller (i.e., the charging device 12) is held via a ball bearing (i.e., a rolling bearing) by the housing of the charging device, which serves as a device disposed opposing an image bearer and including a roller.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. The number, position, and shape of the above-described components are not limited to the description above but can be changed suitably.

What is claimed is:

1. A device disposed opposing an image bearer to bear a toner image, the device comprising;

a roller to rotate while contacting a surface of the image bearer;

a rolling bearing fitted around a shaft located at an end of the roller in an axial direction of the roller, the rolling bearing including:

an outer ring;

an inner ring; and a rolling element disposed between the outer ring and the inner ring;

a frame to house the roller; and a bearing support removably attached to the frame, the bearing support to hold, from an outer-ring side, the rolling bearing interposed between the bearing support and the frame, the bearing support including a receiving portion to contact the outer ring of the rolling bearing and bias the rolling bearing toward the frame in a direction in which the rolling bearing is interposed between the bearing support and the frame, wherein the bearing support includes a plain bearing to fit around the shaft of the roller and fit in the frame, and the receiving portion of the bearing support is to elastically deform starting from a boundary of the plain bearing.

2. The device according to claim 1, wherein the receiving portion of the bearing support includes two arc-shaped portions spaced in an arc direction following the outer ring, the two arc-shaped portions shaped to fit the outer ring, the two arc-shaped portions extending from the boundary of the plain bearing.

3. The device according to claim 1, wherein the receiving portion of the bearing support is thinner than the plain bearing.

4. The device according to claim 1, wherein an inner side of the plain bearing is tapered to progressively decrease an inner diameter of the plain bearing in an insertion direction of the shaft, and wherein the shaft is press-fitted in the plain bearing.

5. The device according to claim 1, further comprising a screw to screw the bearing support to the frame.

6. The device according to claim 5, wherein the rolling bearing and the bearing support are disposed at each end of the roller in the axial direction of the roller, and wherein the bearing support disposed on a driving side, to which a driving force to rotate the roller is input, is screwed to the frame.

7. The device according to claim 5, wherein the bearing support has a through hole into which the shaft of the roller is inserted with a clearance secured.

8. The device according to claim 1, wherein the receiving portion of the bearing support includes a hemispherical projection to contact the outer ring of the rolling bearing.

9. The device according to claim 1, wherein the rolling bearing is disposed at each end of the roller in the axial direction of the roller, wherein the bearing support is disposed on a driven side of the roller opposite a driving side to which a driving force to rotate the roller is input, and wherein the frame further includes a hearing support portion formed as a single part with the frame, where the bearing support portion is substantially identical in structure to the bearing support.

10. The device according to claim 1, further comprising a seal disposed between the bearing support and the image bearer, wherein the frame includes an arc portion shaped to conform to the outer ring, the arc portion disposed in contact with the outer ring of the rolling bearing.

11. The device according to claim 1, wherein the rolling bearing is a ball bearing.

12. The device according to claim 11, further including a biasing member to bias the inner ring, together with the roller, to one side in the axial direction of the roller, wherein the outer ring contacts the frame to determine a position of the outer ring relative to the frame in the axial direction of the roller, and wherein the inner ring of the ball bearing fits around the shaft of the roller to determine a position of the inner ring relative to the roller in the axial direction.

13. The device according to claim 12, wherein the biasing member includes one of a sliding member and an elastic body, and wherein the biasing member is disposed between the bearing support and an end face of the shaft of the roller.

14. The device according to claim 12, further comprising a driven coupling disposed on the shaft of the roller, the driven coupling to engage a driving coupling of an apparatus in which the device is mounted, wherein the biasing member includes a spring to bias the driving coupling, to one side in the axial direction of the roller.

15. The device according to claim 1, further comprising:

a solid lubricant on which the roller slides; and a lubricant biasing member to bias the solid lubricant to the roller, wherein the device is a lubricant supply device to supply lubricant to the surface of the image bearer, and wherein the roller is a lubricant supply roller to rotate and slidingly contact the image bearer and the solid lubricant.

16. A process cartridge to be removably mounted in an image forming apparatus, the process cartridge comprising:

the image bearer; and the device according, to claim I disposed opposing, the image bearer.

17. An image forming apparatus comprising:

the image bearer; and the device according, to claim I disposed opposing, the image bearer.

18. A device disposed opposing an image bearer to bear a toner image, the device comprising;

a roller to rotate while contacting a surface of the image bearer:

a rolling bearing fitted around a shaft located at an end of the roller in an axial direction of the roller, the rolling bearing including:

an outer ring;

an inner ring; and a rolling element disposed between the outer ring and the inner ring;

a frame to house the roller;

a bearing support removably attached to the frame, the bearing support to hold, from an outer-ring side, the rolling bearing interposed between the bearing support and the frame, the bearing support including a receiving portion to contact the outer ring of the rolling bearing and bias the rolling bearing toward the frame in a direction which the rolling bearing is interposed between the bearing support and the frame; and an elastic body disposed between the outer ring of the rolling bearing and the frame.

19. A device disposed opposing an image bearer to bear a toner image, the device comprising;

a roller to rotate while contacting a surface of the image bearer;

a fame to house the roller;

a ball bearing including:

an outer ring disposed in contact with the frame to determine a position of the outer ring relative to the frame in an axial direction of the roller;

an inner ring to fit around a shaft of the roller to determine a position of the inner ring relative to the roller in the axial direction; and a ball disposed between the outer ring and the inner ring; and a biasing member to bias the inner ring, together with the roller, to one side in the axial direction of the roller.

20. The device according to claim 19, further comprising:

a solid lubricant on which the roller slides; and a lubricant biasing member to bias the solid lubricant to the roller, wherein the device is a lubricant supply device to supply lubricant to the surface of the image bearer, and wherein the roller is a lubricant supply roller to rotate and slidingly contact the image bearer and the solid lubricant.

* * * * *